US008047541B2

(12) United States Patent
Segawa

(10) Patent No.: US 8,047,541 B2
(45) Date of Patent: Nov. 1, 2011

(54) DUPLICATE FEEDING DETECTION DEVICE FOR SHEET-LIKE MEMBER

(75) Inventor: Takeshi Segawa, Nagano (JP)

(73) Assignee: Nidec Sankyo Corporation (JP)

( * ) Notice: Subject to any disclaimer, the term of this patent is extended or adjusted under 35 U.S.C. 154(b) by 0 days.

(21) Appl. No.: 12/396,997

(22) Filed: Mar. 3, 2009

(65) Prior Publication Data

US 2009/0230617 A1 Sep. 17, 2009

(30) Foreign Application Priority Data

Mar. 3, 2008 (JP) ..... 2008-052743

(51) Int. Cl.
*B65H 7/02* (2006.01)

(52) U.S. Cl. ..... 271/265.04

(58) Field of Classification Search ..... 271/262, 271/263, 265.04
See application file for complete search history.

(56) References Cited

U.S. PATENT DOCUMENTS 4,412,147 A * 10/1983 Nagura et al. ..... 600/443
2005/0275159 A1* 12/2005 Yoshimura et al. ..... 271/265.04

FOREIGN PATENT DOCUMENTS

JP 2006-1691 A 1/2006
JP 2006-298598 A 11/2006

* cited by examiner

*Primary Examiner* — Michael McCullough
(74) *Attorney, Agent, or Firm* — Cantor Colburn LLP

(57) ABSTRACT

A duplicate feeding detection device for use with sheet-like members may include a control part for controlling an ultrasonic transmission part, a duplicate feeding judging part for judging duplicate feeding of the sheet-like members on a basis of an output from an ultrasonic receiving part, a temperature measuring part for measuring temperature of a vicinity of the ultrasonic transmission part, and a memory part in which a relationship between an oscillation frequency of the ultrasonic transmission part and a temperature is stored. The control part sets an oscillation frequency corresponding to a temperature which is measured by the temperature measuring part on a basis of the relationship between the oscillation frequency and the temperature stored in the memory part.

5 Claims, 5 Drawing Sheets

DUPLICATE FEEDING DETECTION DEVICE FOR SHEET-LIKE MEMBER

CROSS REFERENCE TO RELATED APPLICATION

The present invention claims priority under 35 U.S.C. §119 to Japanese Application No. 2008-052743 filed Mar. 3, 2008 which is incorporated herein by reference.

FIELD OF THE INVENTION

An embodiment of the present invention may relate to a duplicate feeding detection device which is capable of detecting duplicate feeding of a sheet-like member by an ultrasonic sensor.

BACKGROUND OF THE INVENTION

When a sheet-like member such as a check, a paper money, a printing paper or a manuscript is fed to recognize characters or the like provided on the sheet-shaped member, duplicate feeding in which a plurality of papers is simultaneously feed in an overlapped manner is required to be prevented.

In order to prevent the duplicate feeding, a technique utilizing ultrasonic wave has been known in which a ultrasonic transmitter and a ultrasonic receiver are disposed on opposite faces of a transfer passage for feeding a sheet-like member and, when ultrasonic wave emitted from the ultrasonic transmitter is received with the ultrasonic receiver, duplicate feeding is judged on the basis of an attenuation amount of the ultrasonic wave transmitting through the sheet-like member.

In the technique with the use of ultrasonic wave, in order to stably detect duplicate feeding, an amplification factor of the ultrasonic receiver is increased so as to detect a minute difference of an attenuation amount of the ultrasonic wave regardless of a condition of the sheet-like member such as difference of its thickness, a wrinkled state or a folded state.

However, when the amplification factor of the ultrasonic receiver is increased, an external noise is also amplified simultaneously and an S/N ratio is lowered. Therefore, a technique has been known in which, in order to efficiently enhance a reception level while restraining dispersion of element characteristics such as sensitivity, resonance frequency and directivity of the ultrasonic transmitter and the ultrasonic receiver, a frequency of the ultrasonic wave emitted from the ultrasonic transmitter is made variable and duplicate feeding is detected with the use of the optimum oscillation frequency.

Duplicate feeding detection which is disclosed in Japanese Patent Laid-Open No. 2006-298598 is performed in which an ultrasonic wave with an output voltage and an oscillation frequency having adjusted beforehand is emitted from an ultrasonic transmitter. The output voltage is adjusted so that a voltage is increased in a fixed frequency and the lowest voltage is set to be the output voltage when the reception level of the ultrasonic receiver becomes larger than a predetermined value. Further, the oscillation frequency is adjusted so that, in a case that the reception level of the ultrasonic receiver does not become more than the predetermined value even when the voltage of the ultrasonic transmitter is increased, the frequency is varied in a specified range and the step in which the voltage is increased is repeated again. The frequency when the reception level of the ultrasonic receiver becomes larger than the predetermined value is determined as the oscillation frequency. A combination of the lowest output voltage and the oscillation frequency whose reception level is high provides a good transmission efficiency for the ultrasonic wave and a high detection accuracy of duplicate feeding.

Duplicate feeding detection which is disclosed in Japanese Patent Laid-Open No. 2006-1691 utilizes that, when the frequency is continuously varied within a predetermined range, the sensitivity of the ultrasonic receiver becomes maximum at a certain frequency regardless of its element characteristics and, in this manner, the accuracy of duplicate feeding detection at the resonance point is enhanced.

However, in the duplicate feeding detection which is disclosed in the former Patent Reference, it is not considered that the resonance frequency varies due to temperature characteristic of the piezo-electric element. Therefore, even when the ultrasonic wave is emitted from the ultrasonic transmitter at a predetermined oscillation frequency regardless of a temperature condition, the output of the ultrasonic transmitter is decreased and thus the reception level of the ultrasonic receiver is also decreased to lower the S/N ratio. Further, the resonance frequency is shifted due to a temperature characteristic of the piezo-electric element and thus a portion with a high S/N ratio is not used in an actual using state.

Further, in the duplicate feeding detection which is disclosed in the latter Patent Reference, accuracy of duplicate feeding detection at a resonance point can be enhanced by sweeping of the frequency. However, duplicate feeding cannot be detected with a high degree of accuracy over a whole area of a sheet-like member to which duplicate feeding detection is to be performed and thus there is a possibility of erroneous detection according to a degree of overlapping of sheet-like members.

SUMMARY OF THE INVENTION

In view of the problems described above, at least an embodiment of the present invention may advantageously provide a duplicate feeding detection device in which, in consideration of a temperature characteristic of an ultrasonic transmitter, an ultrasonic wave is emitted from the ultrasonic transmitter to an ultrasonic receiver with an oscillation frequency and a voltage so that a transmission efficiency of the ultrasonic wave is enhanced and which is capable of detecting duplicate feeding with a high degree of detection accuracy.

In order to solve the problems described above, at least an embodiment of the present invention provides a duplicate feeding detection device in which a temperature of an ultrasonic transmission part or its vicinity is measured by a temperature measuring part and which includes a control part for controlling an oscillation frequency of an ultrasonic wave which is emitted from the ultrasonic transmission part on the basis of the measured result of the temperature. Alternatively, the duplicate feeding detection device includes a control part for controlling a drive voltage which is applied to the ultrasonic transmission part on the basis of the measured result of the temperature.

According to at least an embodiment of the present invention, there may be provided a duplicate feeding detection device for a sheet-like member including a feeding passage on which sheet-like members are carried, an ultrasonic transmission part which is disposed on one side of the feeding passage for emitting an ultrasonic wave having a predetermined oscillation frequency, an ultrasonic receiving part which is disposed on the other side of the feeding passage for receiving the ultrasonic wave from the ultrasonic transmission part, a duplicate feeding judging part for judging duplicate feeding of the sheet-like members on basis of an output from the ultrasonic receiving part, a control part for controlling the ultrasonic transmission part, a temperature measuring part for measuring a temperature of the ultrasonic transmission part or a vicinity of the ultrasonic transmission part, and a memory part in which a relationship between an oscillation frequency and a temperature is stored. The control part sets an oscillation frequency corresponding to a temperature which is measured by the temperature measuring part as the predetermined oscillation frequency on basis of the relationship between the oscillation frequency and the temperature which is stored in the memory part and the control part controls the ultrasonic transmission part so as to emit the ultrasonic wave having the predetermined oscillation frequency.

According to the embodiment described above, the oscillation frequency is set as the predetermined oscillation frequency so as to correspond to the temperature which is measured by the temperature measuring part on basis of the relationship between the oscillation frequency and the temperature which is stored in the memory part and the ultrasonic wave having the set oscillation frequency is emitted from the ultrasonic transmission part. Therefore, the duplicate feeding detection device is provided which is capable of detecting duplicate feeding by using the oscillation frequency in consideration of the temperature characteristic.

In accordance with an embodiment of the invention, the relationship between the oscillation frequency and the temperature which is stored in the memory part corresponds to a change of a resonance frequency corresponding to a change of the temperature in the ultrasonic transmission part. In this case, it is preferable that the ultrasonic transmission part includes a piezo-electric element which is oscillated at the resonance frequency, and a change of the resonance frequency of the piezo-electric element corresponding to a change of the temperature is stored in the memory part as the relationship between the oscillation frequency and the temperature. According to the embodiment described above, when a temperature is measured by the temperature measuring part, the oscillation frequency is immediately determined and thus temperature may be measured by the temperature measuring part at the time when the sheet-like members are to be fed and duplicate feeding is detected by using the optimum oscillation frequency.

Further, according to at least an embodiment of the present invention, there may be provided a duplicate feeding detection device for a sheet-like member including a feeding passage on which sheet-like members are carried, an ultrasonic transmission part which is disposed on one side of the feeding passage and to which a predetermined drive voltage is applied for emitting an ultrasonic wave, an ultrasonic receiving part which is disposed on the other side of the feeding passage for receiving the ultrasonic wave from the ultrasonic transmission part, a duplicate feeding judging part for judging duplicate feeding of the sheet-like members on basis of an output from the ultrasonic receiving part, a control part for controlling the ultrasonic transmission part, a temperature measuring part for measuring a temperature of the ultrasonic transmission part or a vicinity of the ultrasonic transmission part, and a memory part in which a relationship between a drive voltage for driving the ultrasonic transmission part and a temperature is stored. The control part sets a drive voltage corresponding to the temperature which is measured by the temperature measuring part as the predetermined drive voltage on the basis of the relationship between the drive voltage and the temperature stored in the memory part, and the set drive voltage is applied to the ultrasonic transmission part.

According to the embodiment described above, a drive voltage corresponding to the temperature which is measured by the temperature measuring part is set as the predetermined drive voltage on the basis of the relationship between the drive voltage and the temperature stored in the memory part, and the set drive voltage is applied to the ultrasonic transmission part. Therefore, a duplicate feeding detection device is obtained which is capable of detecting duplicate feeding by applying the drive voltage in consideration of the temperature characteristic.

In accordance with an embodiment of the invention, a memory part in which a relationship between an oscillation frequency and a temperature is stored is provided, the ultrasonic transmission part emits the ultrasonic wave having a predetermined oscillation frequency, and the control part sets an oscillation frequency corresponding to a temperature which is measured by the temperature measuring part as the predetermined oscillation frequency on basis of the relationship between the osculation frequency and the temperature which is stored in the second memory part, and the control part controls the ultrasonic transmission part so as to emit the ultrasonic wave having the predetermined oscillation frequency.

According to the embodiment described above, the oscillation frequency corresponding to the temperature which is measured by the temperature measuring part is set as the predetermined oscillation frequency on basis of the relationship between the oscillation frequency and the temperature which is stored in the memory part, and the drive voltage corresponding to the temperature which is measured by the temperature measuring part is set as the predetermined drive voltage on basis of the relationship between the drive voltage and the temperature stored in the memory part. In addition, the set drive voltage is applied to the ultrasonic transmission part and the ultrasonic transmission part emits the ultrasonic wave having the set oscillation frequency. Therefore, the duplicate feeding detection device is provided which is capable of detecting duplicate feeding at the drive voltage and the oscillation frequency in consideration of the temperature characteristic.

In accordance with an embodiment of the invention, the drive voltage which is stored in the memory part is predetermined on the basis of an inverse function of a function which is defined by a relationship between an output of the ultrasonic wave which is emitted at the resonance frequency and received by the ultrasonic receiving part and a temperature.

According to the embodiment of the present invention, the drive voltage is obtained on the basis of an inverse function of a function which is defined by a relationship between the output of the ultrasonic wave which is emitted at the resonance frequency and a temperature. Therefore, a duplicate feeding detection device is obtained which is capable of detecting duplicate feeding at the drive voltage in consideration of the temperature characteristic.

In this specification, "relationship between an oscillation frequency and a temperature" and "relationship between a drive voltage and a temperature" which are stored in memory parts may be temperature characteristics of a piezo-electric element itself or may be temperature characteristics obtained as calculated results based on the temperature characteristics of the piezo-electric element itself. When the temperature characteristics of the piezo-electric element itself are utilized, the predetermined oscillation frequency and the predetermined drive voltage are set after required calculation has been performed in the control part.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENTS

An embodiment of the present invention will be described below with reference to the accompanying drawings.

Figure 1:
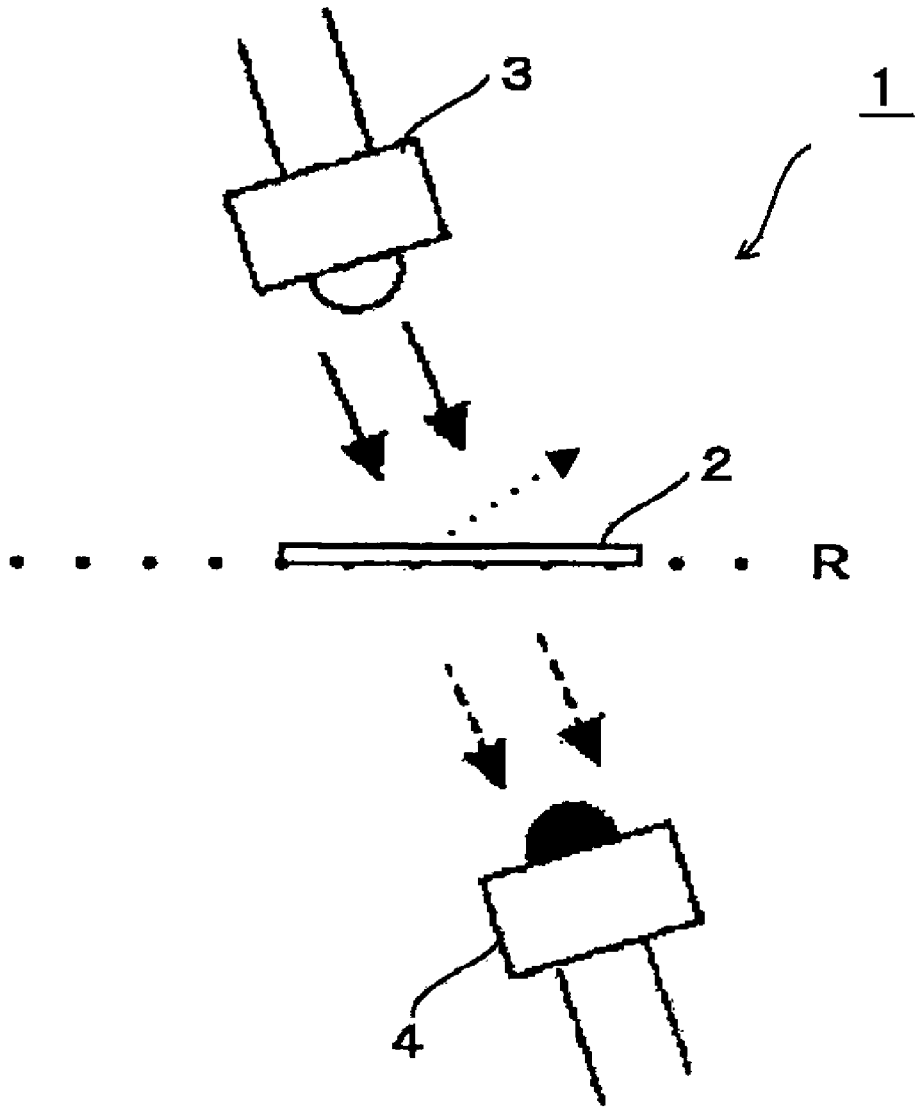
FIG. 1 is an explanatory view showing a principle of duplicate feeding detection in a duplicate feeding detection device in accordance with an embodiment of the present invention.

FIG. 1 is an explanatory view showing a principle of duplicate feeding detection in a duplicate feeding detection device 1 in accordance with an embodiment of the present invention. Throughout this specification, the term ultrasonic wave is used, however as defined as herein, this may include an ultrasonic wave, ultrasonic waves plural, and/or ultrasonic electromagnetic radiation.

The duplicate feeding detection device 1 is structured so that an ultrasonic wave is emitted from an ultrasonic transmitter 3 and the ultrasonic wave is reflected by or transmitted through a sheet-like member 2, which is carried on a transfer passage "R", and the transmitted ultrasonic wave is received with an ultrasonic receiver 4 to be judged whether or not duplicate feeding is occurred on the basis of the reception level. As shown in FIG. 1, the ultrasonic transmitter 3 and the ultrasonic receiver 4 are disposed so as not to face the sheet-like member 2 in a perpendicular manner. When they are disposed to face the sheet-like member 2 in a perpendicular manner, a reception level of the ultrasonic wave which is transmitted through the sheet-like member 2 to reach to the ultrasonic receiver 4 becomes larger, which hardly causes a difference of transmitted ultrasonic waves between a case of overlapped sheet-like members 2 and a case of non-overlapped sheet-like members 2 and thus an accurate judgment for duplicate feeding is difficult However, when they are disposed so as not to face in a perpendicular manner, a transmitting amount through the sheet-like member 2 is reduced. In other words, the emitted ultrasonic wave is reflected by the sheet-like member 2 and a reception level of the ultrasonic wave which is received by the ultrasonic receiver 4 is lowered and thus a difference of reflected ultrasonic waves between a case of overlapped sheet-like members 2 and a case of non-overlapped sheet-like members 2 becomes larger and, as a result, an accurate judgment for duplicate feeding is attained. Further, when they are disposed to face in a perpendicular manner, the ultrasonic wave emitted from the ultrasonic transmitter 3 is reflected by the sheet-like member 2 and returned, which may cause a malfunction but, according to this embodiment, this malfunction is prevented.

The duplicate feeding detection device 1 which is used in a check scanner or a copying machine is provided with temperature characteristics such that oscillation frequency of piezo-electric elements in the ultrasonic transmitter 3 and the ultrasonic receiver 4 is varied or its transmission level and reception level are varied due to increase of operating environment temperature and internal heat. Therefore, accuracy of duplicate feeding detection to temperature characteristics can be improved by selecting an appropriate oscillation frequency and an appropriate transmission/reception level according to a temperature.

Figure 2:
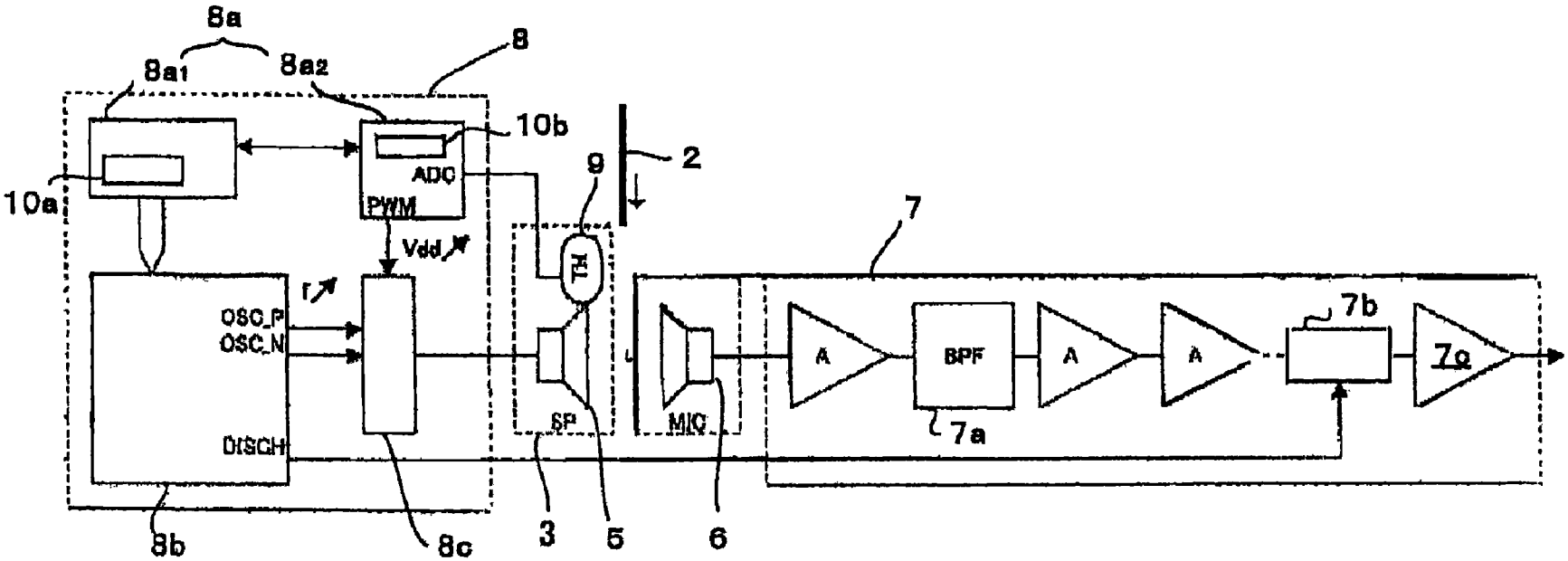
FIG. 2 is a block diagram showing a structure of a duplicate feeding detection device in accordance with an embodiment of the present invention.

FIG. 2 is a block diagram showing a structure of the duplicate feeding detection device 1 in accordance with an embodiment of the present invention.

The duplicate feeding detection device 1 includes an ultrasonic transmission part 5, an ultrasonic receiving part 6, a duplicate feeding judging part 7, a control part 8, a temperature measuring part 9 and memory parts 10*a* and 10*b*.

Figure 3:
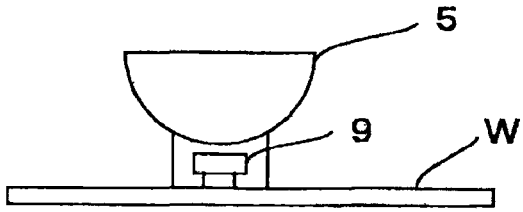
FIG. 3 is a view showing a structural relationship of an ultrasonic transmission part with a temperature measuring part.

The ultrasonic transmission part 5 includes a piezo-electric element which is applied with a predetermined drive voltage to be driven and an ultrasonic wave having a predetermined oscillation frequency is emitted to the ultrasonic receiving part 6, The ultrasonic transmission part 5 faces the ultrasonic receiving part 6, which is disposed on one side across the transfer passage through which a sheet-like member is carried, in an inclined state with respect to the sheet-like member 2 as shown in FIG. 1 in reference to ultrasonic transmitter 3. The temperature measuring part 9 includes, for example, a thermistor and a temperature of the ultrasonic transmission part 5 or its vicinity is measured by measuring a terminal voltage of the thermistor. Therefore, the temperature measuring part 9 is provided so as to be adjacent to the ultrasonic transmission part 5 and a temperature of the piezo-electric element which is incorporated into the ultrasonic transmission part 5 is measured indirectly. As a specific structure, the ultrasonic transmission part 5 is mounted on a circuit board "W" and the temperature measuring part 9 such as a thermistor is mounted on an under side of the ultrasonic transmission part 5 so as to be adjacent thereto (see FIG. 3). Alternatively, the ultrasonic transmission part 5 may be a part of the ultrasonic transmitter 3 and the ultrasonic transmitter 3 may be structured of the ultrasonic transmission part 5 and the temperature measuring part 9 which are integrated with each other.

The ultrasonic receiving part 6 receives ultrasonic wave emitted from the ultrasonic transmission part 5 and is disposed on the other side so as to face one side where the ultrasonic transmission part 5 is disposed across the transfer passage through which a sheet-like member 2 is carried.

The duplicate feeding judging part 7 is connected to the ultrasonic receiving part 6 to judge whether or not duplicate feeding of a sheet-like member 2 is occurred on the basis of an output from the ultrasonic receiving part 6. Specifically, the duplicate feeding judging part 7 is provided with a function in which, after the ultrasonic wave received by the ultrasonic receiving part 6 has been amplified, only a predetermined frequency region is passed through a band-pass filter (BPF) 7*a* and then, the ultrasonic wave in the predetermined frequency region is further amplified and then, a peak of the ultrasonic wave is held in a peak hold circuit 7*b* and then, the peak is judged in a judgment circuit 7*c* whether or not the peak value is equal to or more than a predetermined fixed peak value. For example, when the judgment circuit 7*c* judges that the peak value is equal to or more than a predetermined fixed peak value, it is judged that it is not duplicate feeding and, when the judgment circuit 7*c* judges that the peak value is less than the predetermined fixed peak value, it is judged to be duplicate feeding.

It is preferable that a predetermined frequency region of the band-pass filter (BPF) 7*a* through which the ultrasonic wave is passed is set within a region where an oscillation frequency is variable in the control section 8. Frequency components of the ultrasonic wave received by the ultrasonic receiving part 6 include frequency components such as an external noise in addition to the frequency component of the ultrasonic wave emitted from the ultrasonic transmission part 5 under a control of the control section 8. The frequency components such as the external noise are eliminated by the band-pass filter (BPF) 7*a*.

The control section 8 controls an oscillation frequency of the ultrasonic wave, which is emitted from the ultrasonic transmission part 5, and a drive voltage which is applied to the ultrasonic transmission part 5. The control section 8 is structured of a calculation control section 8*a*, an oscillation frequency control section 8*b* and a drive voltage control section 8*c*.

The calculation control section 8*a* calculates and sets a predetermined oscillation frequency of the ultrasonic wave, which is emitted from the ultrasonic transmission part 5, and a drive voltage, which is applied to the ultrasonic transmission part 5, on the basis of a temperature which is measured by using the temperature measuring part 9. The calculation control section 8*a* is structured of an oscillation frequency calculation control section 8*a*1 and a drive voltage calculation control section 8*a*2. The oscillation frequency calculation control section 8*a*1 sets an oscillation frequency (resonance frequency) which is applied to the ultrasonic transmission part 5 by means of that an analog temperature information which is measured by the temperature measuring part 9 is converted into a digital signal and calculated on the basis of the obtained digital temperature information. The calculations are described further below in reference to FIG. 4. Further, the drive voltage calculation control section 8*a*2 calculates and sets a drive voltage which is applied to the ultrasonic transmission part 5 and the drive voltage calculation control section 8*a*2 is capable of sending and receiving a command to and from the oscillation frequency calculation control section 8*a*1. Therefore, the oscillation frequency calculation control section 8*a*1 calculates and sets a predetermined oscillation frequency of the ultrasonic wave which is emitted from the ultrasonic transmission part 5 on the basis of a temperature information obtained from the temperature measuring part 9 through the oscillation frequency calculation control section 8*a*1. The oscillation frequency control section 8*b* sends pulses to the ultrasonic transmission part 5 through the drive voltage control section 8*c* so as to generate an oscillation frequency which is set in the oscillation frequency calculation control section 8*a*1. The drive voltage control section 8*c* makes the ultrasonic transmission part 5 oscillate at an oscillation frequency (resonance frequency) which is set by the oscillation frequency control section 8*b* and receives a drive voltage which is determined by the drive voltage calculation control section 8*a*2 and thus the ultrasonic wave having the above-mentioned oscillation frequency and drive voltage is emitted from the ultrasonic transmission part 5. In accordance with an embodiment of the present invention, calculation and setting of the drive voltage may be performed in the osculation frequency calculation control section 8*a*1 instead of calculating and setting of the drive voltage in the drive voltage calculation control section 8*a*2.

The memory parts 10*a* and 10*b* are provided as a part of the oscillation frequency calculation control section 8*a*1 and a part of the drive voltage calculation control section 8*a*2 of the control section 8. The memory part 10*a* stores a relationship between an oscillation frequency and a temperature in the ultrasonic transmission part 5, in other words, stores an oscillation frequency (resonance frequency) corresponding to a temperature. Further, the memory part 10*b* stores a relationship between a temperature and a drive voltage which is applied to the ultrasonic transmission part 5. Specifically, temperature characteristics shown in FIG. 4 (relationship between temperature and oscillation frequency (resonance frequency) and relationship between temperature and drive voltage) are stored as a data table.

Figure 4:
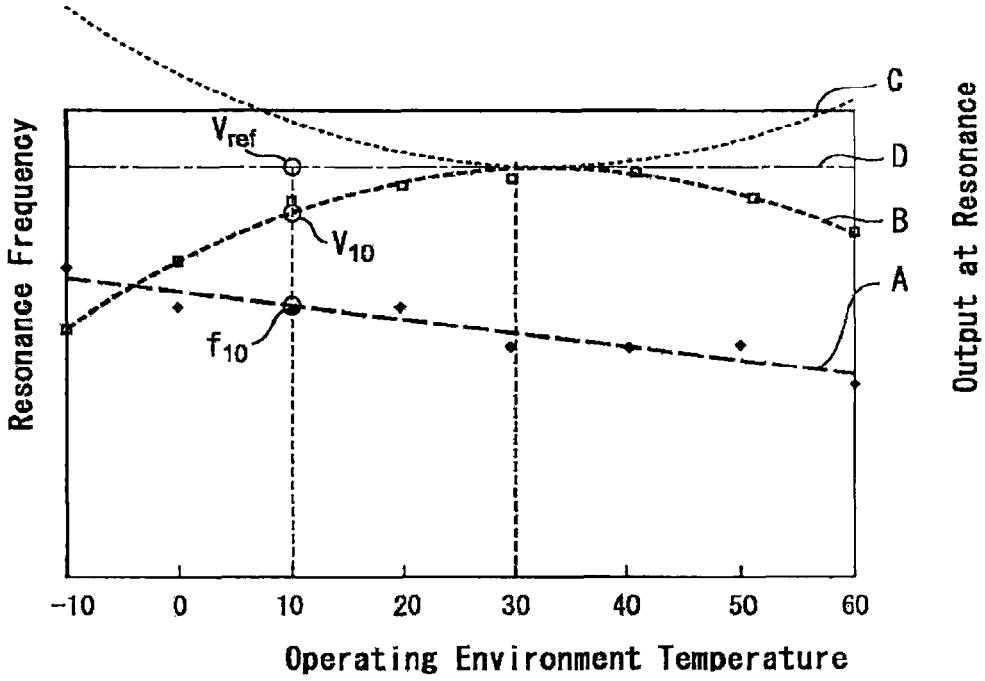
FIG. 4 is a view showing temperature characteristics of an ultrasonic transmission part.

Temperature characteristics shown in FIG. 4 are as follows. The line "A" represents a resonance frequency characteristic corresponding to an operating environment temperature. Specifically, the ultrasonic sensor is provided with a certain resonance frequency and the resonance frequency decreases in an approximately linear manner in a range where its ambient temperature varies from −10 degrees Celsius (° C.) to 60 degrees Celsius (° C.). The line "B" represents an output characteristic at the time of resonance corresponding to the operating environment temperature and a reception output level at the resonance frequency represents a quadratic function where the output level is decreased at a higher and lower temperature with about 30 degrees Celsius (° C.) as a center in a range where its ambient temperature varies from −10 degrees Celsius (° C.) to 60 degrees Celsius (° C.). The line "C" is a correction function for the line "B", which is an inverse function with respect to the curve "B" whose apex is about at 30 degrees Celsius, in other words, the line "C" is expressed as a computing equation of a function that is symmetrical to the line "B" with the X-axis at the apex point at about 30 degrees Celsius. The line "D" is the corrected output (ideal output). When the drive voltage in the ultrasonic transmission part 5 is corrected by the inverse function "C" to the curve "B", the corrected output (ideal output) is obtained and thus judgment of duplicate feeding can be performed with the fixed output at the time of resonance regardless of the operating environment temperature. Especially, the corrected drive voltage which is obtained from the relationship between the operating environment temperature and the drive voltage is obtained on the basis of the inverse function "C" of the function "B" which is specified by the relationship between the output at the time of resonance and the operating environment temperature. The output at the time of resonance is an output which is received by the ultrasonic receiving part 6 when the ultrasonic wave having the resonance frequency is transmitted from the ultrasonic transmission part 5. When the function "B" which is defined by the relationship between the output at the time of resonance and the temperature is similar to the quadratic function as shown in FIG. 4, the function "C" is determined so as to be symmetrical to the X-axis with the apex coordinate of the function "B" as a reference, i.e., with the apex coordinate of the output at the time of resonance as a reference. The corrected drive voltage which is obtained from a relationship between the temperature and the drive voltage on the basis of the symmetrical function is applied to the ultrasonic transmission part 5 and thus the ultrasonic transmission part 5 is driven in the optimum situation. In other words, a high portion of the transmission efficiency of the ultrasonic wave is utilized and the ultrasonic transmission part 5 is driven in the state where noise is restrained. For example, when a drive voltage which is lower than the apex coordinate of the Output at the time of resonance is used, its output becomes lower and, on the contrary, when a higher drive voltage is applied, an external noise is increased and, as a result, detection accuracy is lowered. In this embodiment shown in FIG. 4, the temperature corresponding to the apex coordinate of the output at the time of resonance is about 30 degrees Celsius.

Figure 5:
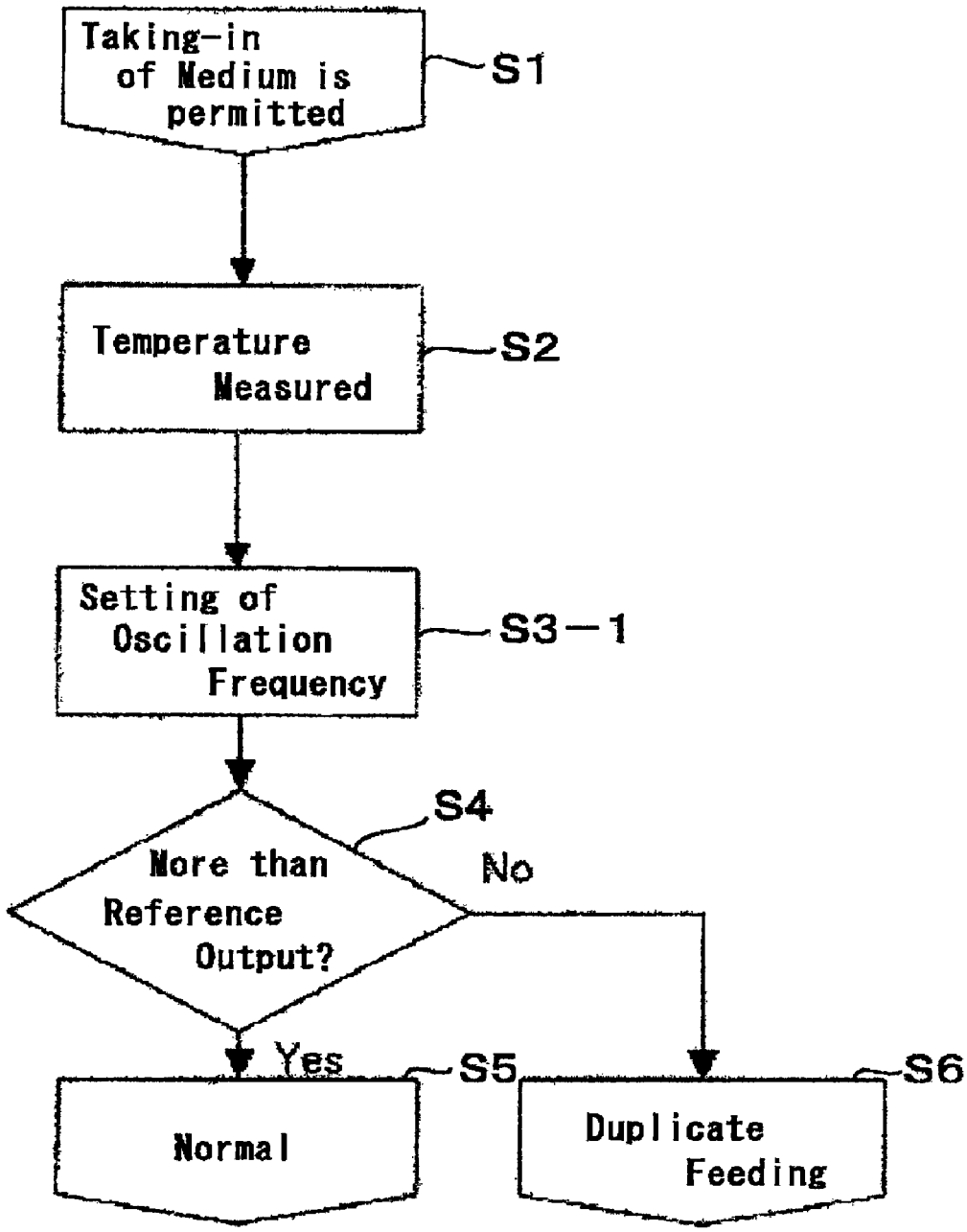
FIG. 5 is a flow chart showing processing steps in a duplicate feeding detection device in accordance with an embodiment of the present invention.

FIG. 5 is a flow chart showing processing steps in the duplicate feeding detection device 1 in accordance with an embodiment of the present invention.

The duplicate feeding detection device 1 in accordance with an embodiment of the present invention is operated at the time of feeding sheet-like members (medium) 2, for example, taking sheet-like members (medium) 2 into the inside of a main device. First, when sheet-like members (medium) 2 are permitted to take-in through a feeding passage (step "S1"), in order to judge presence or absence of duplicate feeding when the sheet-like members (medium) 2 are fed, a temperature at the ultrasonic transmission part 5 is measured by the temperature measuring part 9 (step "S2") and then, an oscillation frequency in the ultrasonic transmission part 5 is set by the control section 8 (step "S3-1").

A drive voltage which is applied to the ultrasonic transmission part 5 may be determined from a result of temperature measurement by the temperature measuring part 9 in the step "S2", for example, when the operating environment temperature is at 10 degrees Celsius, the value of V10 may be inputted as the drive voltage on the basis of the function "B" shown in FIG. 4 which is stored in the memory part. However, in accordance with an embodiment of the present invention, even when the output voltage "V10" at the time of resonance is not changed, duplicate feeding is capable of being detected by adjustment of the oscillation frequency. Therefore, in the step "S3-1", the oscillation frequency (resonance frequency) corresponding to the output voltage "V10" at the time of resonance is set Specifically, when the operating environment temperature is at 10 degrees Celsius, the oscillation frequency "f10" is determined from the function "A". The oscillation frequency (resonance frequency) is set so that a result of temperature measurement by the temperature measuring part 9 is transmitted to an oscillation frequency calculation control section 8*a*1 to calculate the oscillation frequency by using the memory part 10*a* and then, an oscillation frequency control section 8*b* controls so that the calculated oscillation frequency is emitted from the ultrasonic transmission part 5. The ultrasonic wave having the oscillation frequency which is set as described above is emitted from the ultrasonic transmission part 5 to the ultrasonic receiving part 6 and it is judged whether or not the peak level is equal to or more than the reference output on the basis of the peak level of the ultrasonic wave which is received by the ultrasonic receiving part 6 (step "S4").

In the step "S4", when it is judged that the peak level is not less than the reference output, it is determined to be normal (step "S5") and, when the peak level is less than the reference output, it is determined to be duplicate feeding (step "S6").

Figure 6:
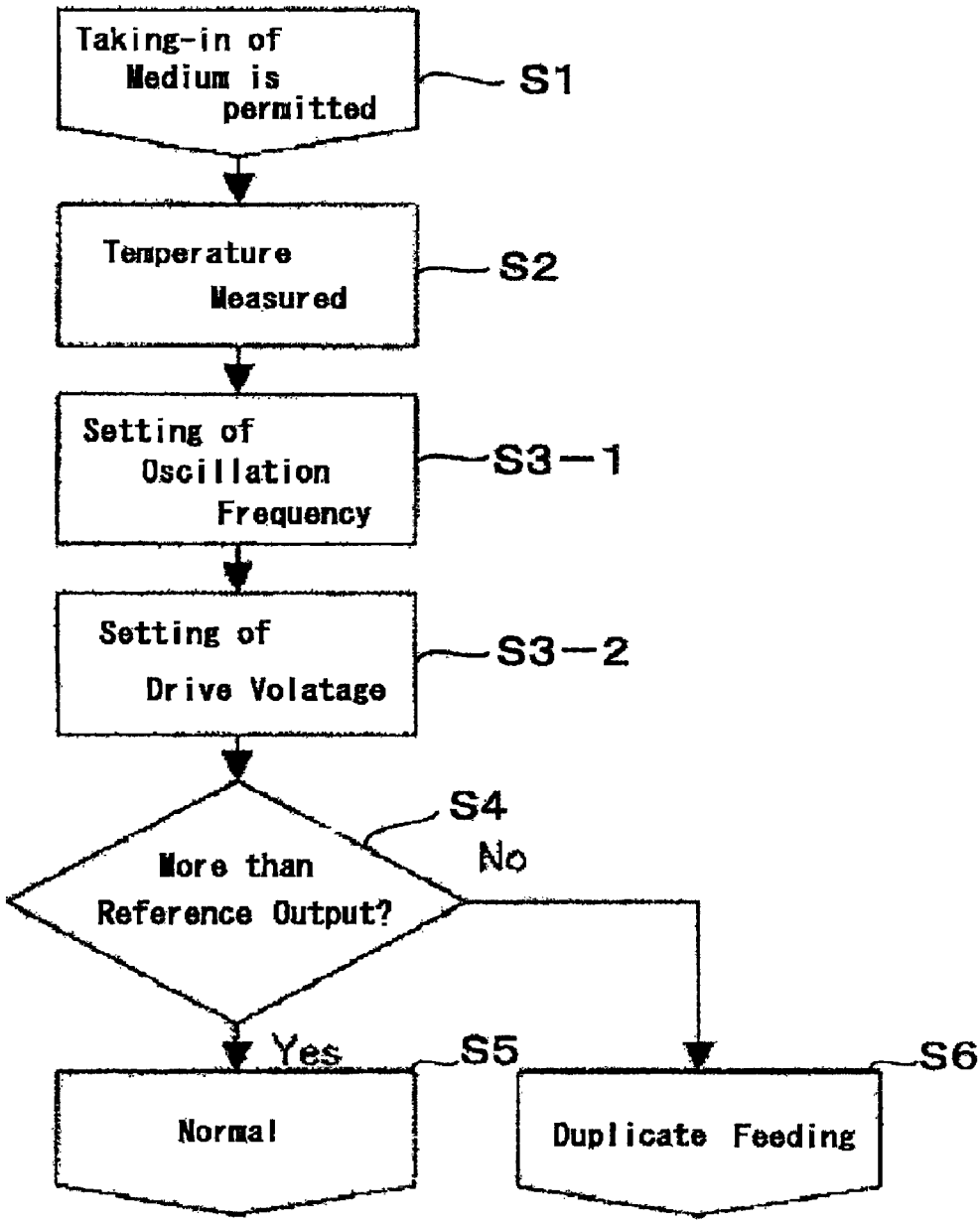
FIG. 6 is a flow chart showing processing steps in a duplicate feeding detection device in accordance with another embodiment of the present invention.

FIG. 6 is a flow chart showing processing steps in a duplicate feeding detection device 1 in accordance with another embodiment of the present invention. The difference from FIG. 5 is that the drive voltage is also changed and controlled as well as the oscillation frequency. When a sufficient characteristic is not obtained only by changing and controlling the oscillation frequency, the drive voltage is also changed and controlled. In this case, any order may be adopted for the setting of the oscillation frequency and the setting of the drive voltage.

In the step "S3-1", when the operating environment temperature is at 10 degrees Celsius, the resonance frequency is set to be "f10" from the function "A". The result of temperature measurement by the temperature measuring part 9 is transmitted to and calculated by the oscillation frequency calculation control section 8*a*1, and the calculated oscillation frequency (resonance frequency) is set and controlled by the oscillation frequency control section 8*b* to be emitted from the ultrasonic transmission part 5.

In the step "S3-2", when the operating environment temperature is at 10 degrees Celsius, the drive voltage in the ultrasonic transmission part 5 is set on the basis of the function "C" so that the output at the time of resonance becomes "Vref". The drive voltage is set so that the result of temperature measurement by the temperature measuring part 9 is transmitted to the drive voltage calculation control section 8*a*2 and the drive voltage is calculated on the basis of the inverse function "C" of the function "B" by using the memory part 10*b* and then, the calculated drive voltage is set and controlled in the drive voltage control section 8*c* so as to emit from the ultrasonic transmission part 5.

The ultrasonic wave having the oscillation frequency set as described above is emitted by using the drive voltage set as described above from the ultrasonic transmission part 5 to the ultrasonic receiving part 6. The peak level of the ultrasonic wave which is received by the ultrasonic receiving part 6 is judged whether or not the peak level is not less than the reference output (step "S4") and then processing similar to FIG. 5 is performed When it is not duplicate feeding or when a plurality of papers are not overlapped each other and not carried simultaneously, the output "Vref" at the time of resonance shown by the line "D", i.e., the corrected output (ideal output) is obtained. However, in the case of duplicate feeding, the peak level of the ultrasonic wave which is received by the ultrasonic receiving part 6 decreases and thus duplicate feeding is detected.

The duplicate feeding detection device in accordance with the present invention is effective as a device in which an ultrasonic wave capable of obtaining an optimum output at an operating environment temperature can be emitted and in which duplicate feeding detection can be performed with a high degree of detection accuracy.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A duplicate feeding detection device for use with sheet members comprising:

a feeding passage on which the sheet members are carried;

an ultrasonic transmission part which is disposed on one side of the feeding passage and to which a predetermined drive voltage is applied to emit an ultrasonic wave;

an ultrasonic receiving part which is disposed on an other side of the feeding passage for receiving the ultrasonic wave from the ultrasonic transmission part;

a duplicate feeding judging part for judging duplicate feeding of the sheet members on a basis of an output from the ultrasonic receiving part;

a control part for controlling the ultrasonic transmission part;

a temperature measuring part for measuring temperature of the ultrasonic transmission part or a vicinity of the ultrasonic transmission part;

a memory part in which a relationship between a drive voltage for driving the ultrasonic transmission part and a temperature is stored; and a second memory part in which a relationship between an oscillation frequency and a temperature is stored;

wherein the control part sets a drive voltage corresponding to the temperature which is measured by the temperature measuring part as the predetermined drive voltage on a basis of the relationship between the drive voltage and the temperature stored in the memory part, and a set drive voltage is applied to the ultrasonic transmission part;

wherein the ultrasonic transmission part emits the ultrasonic wave having a predetermined oscillation frequency; and wherein the control part sets an oscillation frequency corresponding to a temperature which is measured by the temperature measuring part as the predetermined oscillation frequency on a basis of the relationship between the oscillation frequency and the temperature which is stored in the second memory part;

wherein the control part controls the ultrasonic transmission part so as to emit the ultrasonic wave having the predetermined oscillation frequency; and wherein the relationship between the oscillation frequency and the temperature which is stored in the second memory part corresponds to a change of a resonance frequency corresponding to a change of the temperature in the ultrasonic transmission part; and wherein the drive voltage which is stored in the memory part is obtained on a basis of an inverse function of a function which is defined by a relationship between an output of the ultrasonic wave which is emitted at the predetermined oscillation frequency and received by the ultrasonic receiving part and a temperature.

2. The duplicate feeding detection device for use with sheet members according to claim 1, wherein the temperature is measured by the temperature measuring part at a time of feeding the sheet member, and the drive voltage corresponding to a measured temperature is applied to the ultrasonic transmission part.

3. The duplicate feeding detection device for use with sheet members according to claim 1, wherein the ultrasonic transmission part includes a piezo-electric element which is oscillated at the resonance frequency, and a change of the resonance frequency of the piezo-electric element to a change of the temperature is stored in the second memory part as the relationship between the oscillation frequency and the temperature.

4. The duplicate feeding detection device for use with sheet members according to claim 1, wherein the drive voltage which is stored in the memory part is determined so as to maintain a relationship between a resonance output of the ultrasonic wave which is emitted at the predetermined resonance frequency and is received by the ultrasonic receiving part and the temperature at a fixed value.

5. The duplicate feeding detection device for use with a sheet members according to claim 4, wherein the temperature is measured by the temperature measuring part at a time of feeding the sheet member, and the ultrasonic transmission part includes a piezo-electric element that is resonated at the resonance frequency corresponding to a measured temperature, and the drive voltage corresponding to the measured temperature is applied to the ultrasonic transmission part.

wherein the control part sets an oscillation frequency corresponding to a temperature which is measured by the temperature measuring part as the predetermined oscillation frequency on a basis of the relationship between the oscillation frequency and the temperature which is stored in the memory part, and the control part controls the ultrasonic transmission part so as to emit the ultrasonic wave having the predetermined oscillation frequency.

* * * * *